US010914444B2

(12) United States Patent
Toko et al.

(10) Patent No.: US 10,914,444 B2
(45) Date of Patent: Feb. 9, 2021

(54) LAMP UNIT, VEHICULAR LAMP SYSTEM

(71) Applicant: Stanley Electric Co., Ltd., Tokyo (JP)

(72) Inventors: Yasuo Toko, Tokyo (JP); Yoshifumi Takao, Tokyo (JP); Masafumi Ohno, Tokyo (JP); Yoshihisa Iwamoto, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/604,945

(22) PCT Filed: Apr. 19, 2018

(86) PCT No.: PCT/JP2018/016168
§ 371 (c)(1),
(2) Date: Feb. 24, 2020

(87) PCT Pub. No.: WO2018/198939
PCT Pub. Date: Nov. 1, 2018

(65) Prior Publication Data

US 2020/0217472 A1 Jul. 9, 2020

(30) Foreign Application Priority Data

Apr. 24, 2017 (JP) ..... 2017-085417
Apr. 24, 2017 (JP) ..... 2017-085420

(51) Int. Cl.
*F21S 41/20* (2018.01)
*F21S 41/32* (2018.01)
(Continued)

(52) U.S. Cl.
CPC ..... *F21S 41/285* (2018.01); *F21S 41/321* (2018.01); *F21S 41/645* (2018.01); *F21V 9/14* (2013.01)

(58) Field of Classification Search
CPC ..... F21S 41/285; F21S 41/321; F21S 41/645
See application file for complete search history.

(56) References Cited

U.S. PATENT DOCUMENTS 4,985,816 A * 1/1991 Seko ..... F21S 41/43 362/303
5,402,324 A * 3/1995 Yokoyama ..... F21V 9/14 349/112

(Continued)

FOREIGN PATENT DOCUMENTS

JP H09-146092 A 6/1997
JP 2005-183327 A 7/2005

(Continued)

OTHER PUBLICATIONS

International Search Report and Written Opinion of the International Search Report for PCT/JP2018/016168 dated Jul. 17, 2018.

(Continued)

*Primary Examiner* — Anabel Ton
(74) *Attorney, Agent, or Firm* — Kenealy Vaidya LLP

(57) ABSTRACT

To increase the light utilization efficiency when selective light irradiation is performed using a liquid crystal element (a liquid crystal device). A lamp unit including: a light source; a reflective polarizing plate disposed at a position where light from the light source is incident; a reflecting mirror configured to reflect a reflected light generated by the reflective polarizing plate and re-enters the reflected light to the reflective polarizing plate; a liquid crystal device disposed on the light emitting surface side of the reflective polarizing plate; a polarizing plate disposed on the light emitting surface side of the liquid crystal device; and a lens disposed on the light emitting surface side of the polarizing plate.

9 Claims, 6 Drawing Sheets

103R (103L)

(51) Int. Cl.
*F21S 41/64* (2018.01)
*F21V 9/14* (2006.01)

(56) References Cited

U.S. PATENT DOCUMENTS

| | | | | |
|---|---|---|---|---|
| 5,748,369 | A | 5/1998 | Yokota | |
| 10,168,013 | B1 * | 1/2019 | Li | F21S 41/645 |
| 2008/0198372 | A1 | 8/2008 | Pan | |
| 2014/0340588 | A1 | 11/2014 | Kkiyama Koichi | |
| 2015/0029409 | A1 * | 1/2015 | Chen | F21S 41/43 349/5 |
| 2016/0139328 | A1 * | 5/2016 | Hikmet | F21S 43/14 362/84 |
| 2019/0360653 | A1 * | 11/2019 | Toko | F21S 41/321 |
| 2020/0011501 | A1 * | 1/2020 | Kunii | F21S 41/143 |

FOREIGN PATENT DOCUMENTS

| | | | |
|---|---|---|---|
| JP | 2006-147377 | A | 6/2006 |
| JP | 2010-250326 | A | 11/2010 |
| WO | 95/33224 | A1 | 12/1995 |
| WO | 2005/003850 | A1 | 1/2005 |
| WO | 2011/091557 | A1 | 8/2011 |
| WO | 2018/001581 | A1 | 1/2018 |
| WO | 2018/198939 | A1 | 11/2018 |

OTHER PUBLICATIONS

Extended European Search Report for the related European Patent Application No. 18791228.2 dated Dec. 1, 2020.

* cited by examiner 103R (103L)

103R(103L)

4

113R(113L)

123R (123L)

133R (133L)

163R (163L)

LAMP UNIT, VEHICULAR LAMP SYSTEM

CROSS-REFERENCE TO RELATED APPLICATIONS

This application is a U.S. National Stage Application under 35 U.S.C § 371 of International Patent Application No. PCT/JP2018/016168 filed Apr. 19, 2018, which claims the benefit of priority to Japanese Patent Application No. 2017-085417 filed Apr. 24, 2017 and Japanese Patent Application No. 2017-085420 filed Apr. 24, 2017, the disclosures of all of which are hereby incorporated by reference in their entireties.

BACKGROUND OF THE INVENTION

Field of the Invention

The present invention relates to a lamp unit that generates irradiation light with various light distribution patterns and a vehicular lamp system, etc. including the lamp unit.

Description of the Background Art

Japanese Unexamined Patent Application Publication No. 2005-183327 (Patent Document 1) discloses a vehicular headlamp that forms a cut-off suitable for a light distribution pattern of a vehicular headlamp by shielding a part of light emitted forward from a light emitting part, by a light shielding part. In the light shielding part of the vehicular headlamp, an electro-optical element capable of realizing selective light control according to the shape of the light distribution pattern is used. Further, as for the electro-optical element, for example, a liquid crystal element is used.

Here, in the conventional vehicular headlamp described above, for example, when a general TN type liquid crystal element is used as the light shielding part, there is a disadvantage that light utilization efficiency of the light irradiated from the light emitting part is decreased.

This stems from the fact that the light transmittance of the liquid crystal element becomes approximately 35% or less due to the principle that a pair of polarizers are configured as a component of the liquid crystal element, and considering the effect of light absorption by each of the polarizers.

In a specific aspect, it is an object of the present invention to provide a technique capable of increasing the light utilization efficiency when selective light irradiation is performed using a liquid crystal element (a liquid crystal device).

SUMMARY OF THE INVENTION

[1] A lamp unit according to one aspect of the present invention includes: (a) a light source; (b) a reflective polarizing plate disposed at a position where light from the light source is incident; (c) a reflecting mirror configured to reflect a reflected light generated by the reflective polarizing plate and re-enters the reflected light to the reflective polarizing plate; (d) a liquid crystal device disposed on the light emitting surface side of the reflective polarizing plate; (e) a polarizing plate disposed on the light emitting surface side of the liquid crystal device; and (f) a lens disposed on the light emitting surface side of the polarizing plate.

[2] A vehicular lamp system according to one aspect of the present invention is a vehicular lamp system including the lamp unit described above and a control part that controls operations of the light source and the liquid crystal device of the lamp unit.

According to the above configurations, it is possible to increase the light utilization efficiency when performing selective light irradiation using a liquid crystal element (a liquid crystal device).

DESCRIPTION OF THE PREFERRED EMBODIMENTS

Embodiment 1

Figure 1:
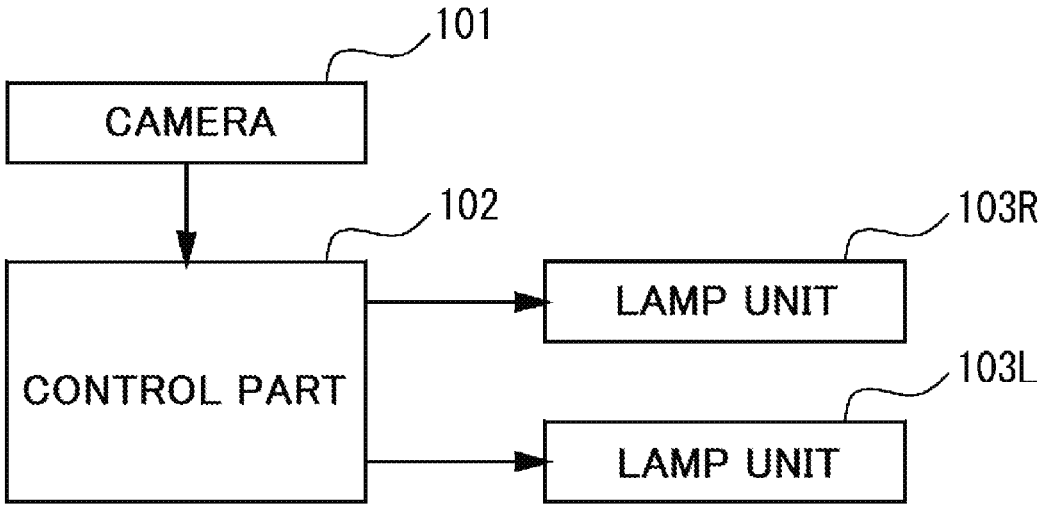
FIG. 1 is a block diagram showing the configuration of a vehicular lamp system according to Embodiment 1.

FIG. 1 is a block diagram showing the configuration of a vehicular lamp system according to Embodiment 1. The vehicular lamp system shown in FIG. 1 detects, based on the image of the surroundings (for example, the front) of the own vehicle photographed by a camera 101, the presence or absence of the target object (for example, an oncoming vehicle, a preceding vehicle, or pedestrians or the like) by performing image recognition process by a control part 102. Then, the vehicular lamp system selectively irradiates light by controlling each of the lamp units 103R and 103L by the control part 102 in accordance with the position of the target object. The camera 101 is arranged at a predetermined position (for example, the upper part of the windshield) in the own vehicle. The control part 102 is realized, for example, by executing a predetermined operation program in a computer system having a CPU, a ROM, a RAM, and the like. With regard to each of the lamp units 103R and 103L, the lamp unit 103R is disposed on the front right side of the own vehicle, and the lamp unit 103L is disposed on the front left side of the own vehicle. Note that the overall configuration of the vehicular lamp system is the same in other embodiments described hereinafter.

Figure 2:
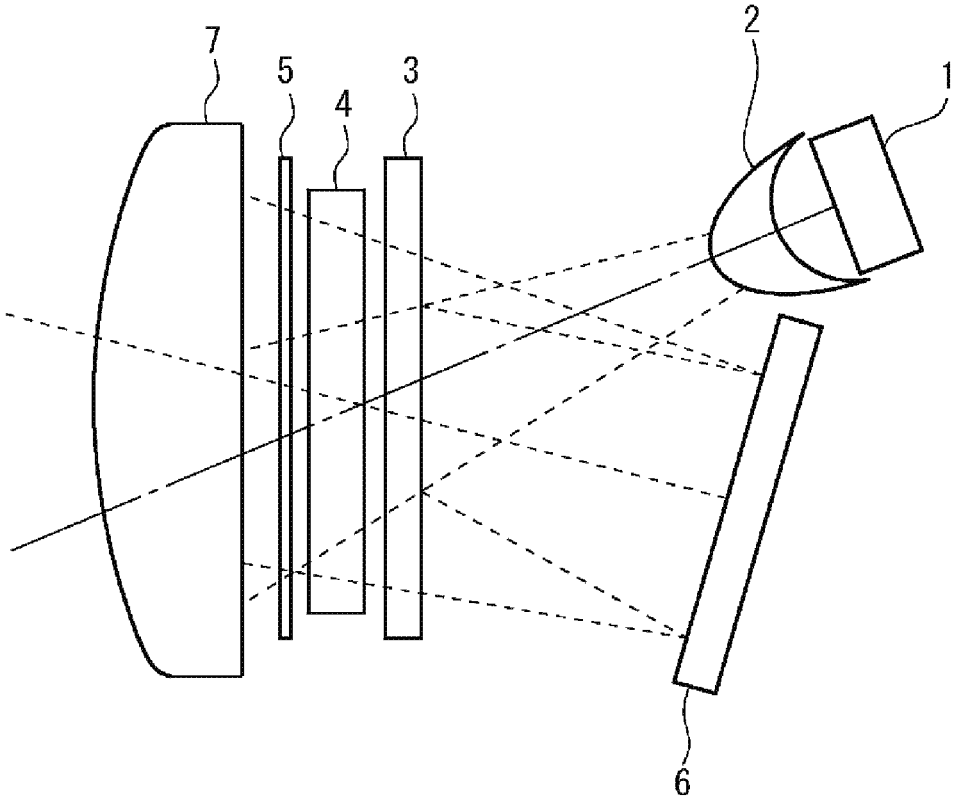
FIG. 2 is a diagram showing a configuration example of a lamp unit according to Embodiment 1.

FIG. 2 is a diagram showing a configuration example of a lamp unit according to Embodiment 1. Although the lamp unit 103R will be described here, note that the lamp unit 103L has the same configuration (the same applies hereinafter). The illustrated lamp unit 103R is configured to include a light source 1, a collimating lens 2, a reflective polarizing plate (a reflecting polarizer) 3, a liquid crystal device 4, a polarizing plate 5, a reflecting mirror 6, and a projection lens 7.

The light source 1 is configured to include a light emitting element such as an LED, and emits white light, for example. The number of light emitting element may be one or more. When a plurality of light emitting elements is used, it is preferable to arrange the light emitting elements in the depth direction on the paper surface of FIG. 2.

The spread angle of the light emitted from the light source 1 is preferably as narrow as possible. Thus, it is also preferable to collimate the emitted light by arranging a lens immediately above the light emitting element such as the LED. Further, it is preferable that the center of the light beam from the light source 1 (indicated by the alternate long and short dash line in the figure) is irradiated near the center of the liquid crystal device 4. The light intensity of the light source 1 is set so that necessary and sufficient luminance can be obtained in consideration of the loss caused by the optical system.

The collimating lens 2 is disposed in front of the light emitting portion of the light source 1 and condenses the light emitted from the light source 1 to convert it into substantially parallel light.

The reflective polarizing plate 3 is, for example, a wire grid polarizing plate which transmits polarized light in a specific direction and reflects polarized light in other directions. The wire grid polarizing plate referred to here is a polarizing plate comprised by providing many thin wires which consist of metal such as aluminum on a hard substrate such as a glass substrate, and is excellent in heat resistance. As for the reflective polarizing plate 3, a reflective polarizing plate using an optical multilayer film may be used.

The liquid crystal device 4 is disposed on the light emitting surface side of the reflective polarizing plate 3 and modulates incident light to form various light distribution patterns. The liquid crystal device 4 has, for example, a plurality of light modulation regions arranged in a matrix and each light modulation region can be controlled independently. As shown in the figure, the liquid crystal device 4 is a flat plate-like device, and is arranged so that its main surface is substantially parallel to the reflective polarizing plate 3.

Further, the liquid crystal device 4 is preferably arranged with a gap (for example, a few millimeters) between the reflective polarizing plate 3 and the polarizing plate 5 without being in close contact with one another. This is because the reflective polarizing plate 3 may gain heat due to the light irradiated from the light source 1, and the heat may be transmitted to the liquid crystal device 4 to cause malfunction. By providing a gap, cooling with a fan or the like is facilitated.

Here, when an optical compensator (not shown in the figure) is to be combined with the liquid crystal device 4, the optical compensator may be directly attached to any one of the liquid crystal device 4, the reflective polarizing plate 3, or the polarizing plate 5. In this case, the optical compensator is disposed so as to be positioned between the reflective polarizing plate 3 and the polarizing plate 5.

The polarizing plate 5 is disposed on the light emitting surface side of the liquid crystal device 4, and the light (the polarized light) transmitted through the liquid crystal device 4 enters thereto. As for the polarizing plate 5, for example, a polarizing plate made of a general organic material (iodine type, dye type, etc.) can be used. Moreover, when importance is attached to heat resistance, a wire grid polarizing plate may be used. In this case, it is preferable to use a wire grid polarizing plate that suppresses surface reflection. Further, the polarizing plate 5 may be configured by stacking a polarizing plate made of an organic material and a wire grid polarizing plate.

The reflecting mirror 6 is disposed at a position facing the light incident surface side of the reflective polarizing plate 3, and when light reflected on the light incident surface of the reflective polarizing plate 3 is incident thereto, this light is reflected and re-enters the reflective polarizing plate 3. This reflecting mirror 6 is not particularly limited, and for example, a reflecting mirror configured by providing a general reflecting film (aluminum film, silver alloy film, optical multilayer film, etc.) on a substrate can be used. The reflecting state of the reflecting mirror 6 is preferably specular reflection, and therefore the surface of the reflecting mirror 6 is preferably configured to be as smooth as possible. When using resin as a base material, the mirror may be made by resin molding, etc.

Regarding the positional relationship among the reflective mirror 6, the light source 1, and the reflective polarizing plate 3, it is preferable that the direction in which the light (the light flux) of the light source 1 regularly reflected by the light incident surface (the reflective surface) of the reflective polarizing plate 3 and the normal direction of the central part of the reflecting surface of the reflective mirror 6 coincides. Further, regarding the positional relationship between the reflecting mirror 6 and the light source 1, it is preferable to arrange the reflecting mirror 6 and the light source 1 in an inclined manner so that the optical axis of the light emitted from the light source 1 and the optical axis of the light reflected by the reflecting mirror 6 are point-symmetric with respect to the normal direction of the light incident surface of the reflective polarizing plate 3 (which is also the central axis of the optical axis of the lamp unit). Further, as shown in the figure, it is most preferable that the light source 1 is disposed relatively on the upper side and the reflecting mirror 6 disposed on the lower side in the vertical direction of the lamp unit. However, the vertical relationship between the light source and the reflecting mirror may be reversed, or the light source 1 and the reflecting mirror 6 may be arranged in the left-right direction.

The projection lens 7 is disposed on the light emitting surface side of the polarizing plate 5 and condenses and projects an image formed by the light transmitted through the polarizing plate 5. This projected image becomes the irradiation light emitted by the vehicular lamp system. As for the projection lens 7, for example, a reversed projection type projector lens having a focal point at a predetermined distance can be used. In this case, a lens having a large NA (numerical aperture) is preferable. This projection lens 7 is preferably arranged so that the above-stated focal point is positioned in the liquid crystal layer (to be described later) portion of the liquid crystal device 4, but it is also possible to slightly deviate the focal point in order to prevent the projected image from becoming too sharp. Further, an image shifting function may be added to the projection lens 7.

In this lamp unit 103R, each component is arranged so that all components of light emitted from the light source 1 (including light reflected by the reflecting mirror 6) are incident on each light control function part (light control electrode forming part which is to be described later) of the liquid crystal device 4 as well as the opening portion of the reflective polarizing plate 3 and the opening portion of the projection lens 7.

Figure 3:
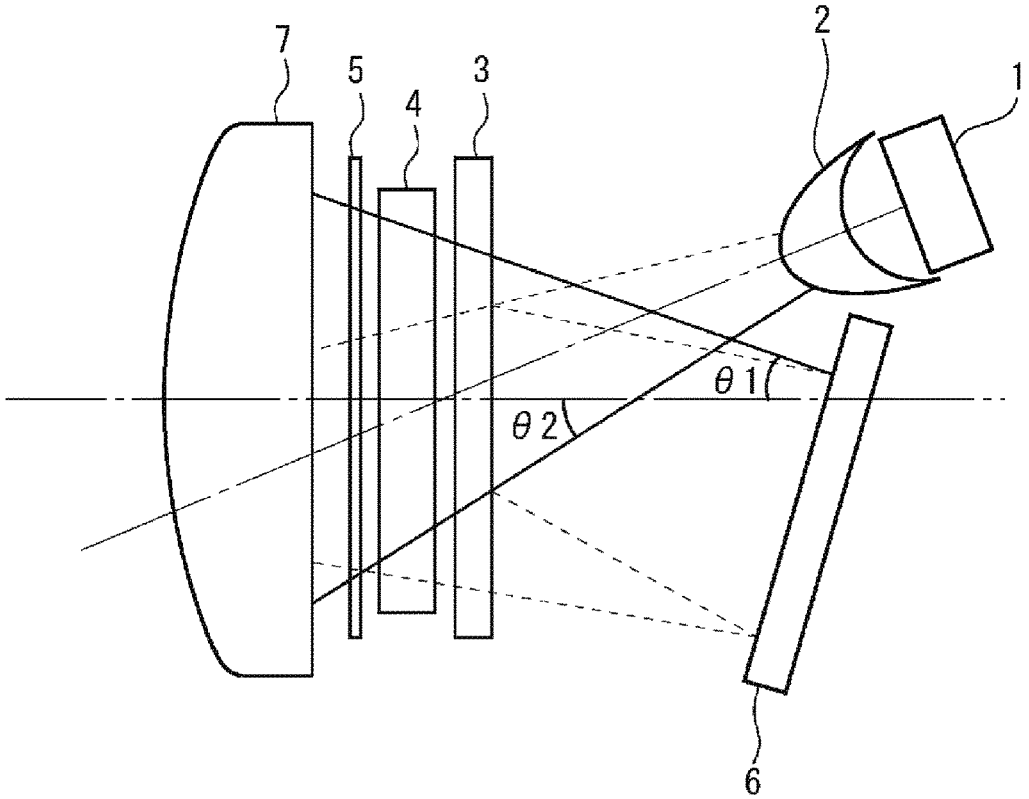
FIG. 3 is a diagram for explaining an index for determining an appropriate NA of the projection lens.

FIG. 3 is a diagram for explaining an index for determining an appropriate NA of the projection lens. Each of the angles θ1 and θ2 defined in the diagram indicates the inclination angle of incident light rays projected to the projection lens 7 that are most inclined with respect to the center line (the alternate long and short dash line) of the projection lens 7. Here, assuming that $\theta 1<\theta 2$, in this case, NA of the projection lens 7 to be selected is determined by the relational expression $NA=\sin \theta 2$. Thus, it is preferable to select (design, manufacture) the projection lens 7 according to the optical system to be used. Here, note that, by optimizing the optical system, it is more preferable to make angle $\theta 1$ and angle $\theta 2$ the same because the NA of the projection lens 7 can be further reduced.

Figure 4:
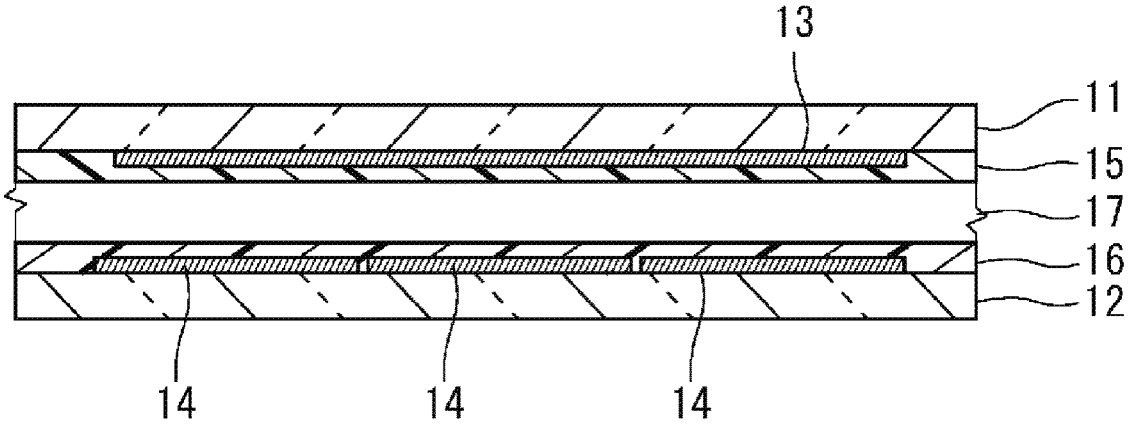
FIG. 4 is a schematic cross-sectional diagram showing a configuration example of the liquid crystal device.

FIG. 4 is a schematic cross-sectional diagram showing a configuration example of the liquid crystal device. The liquid crystal device 4 shown in the figure is configured to include a first substrate 11 and a second substrate 12 disposed opposite to each other, a first electrode 13 provided on the first substrate 11, and a plurality of second electrodes 14 provided on the second substrate 12, and a liquid crystal layer 17 disposed between the first substrate 11 and the second substrate 12. The reflective polarizing plate 3 and the polarizing plate 5 disposed to face each other with the liquid crystal device 4 interposed therebetween are, for example, arranged with their absorption axes substantially orthogonal to each other. In the present embodiment, a normally black mode is assumed, which is an operation mode in which light is shielded (the transmittance becomes extremely low) when no voltage is applied to the liquid crystal layer 17 of the liquid crystal device 4.

Each of the first substrate 11 and the second substrate 12 is a rectangular substrate in a plan view, and is disposed to face each other. As for each substrate, for example, a transparent substrate such as a glass substrate or a plastic substrate can be used. Between the first substrate 11 and the second substrate 12, for example, a large number of spacers are uniformly distributed and these spacers keep the substrate gap at a desired size (for example, approximately a few micrometers).

The first electrode 13 is provided on one surface side of the first substrate 11. Each second electrode 14 is provided on one surface side of the second substrate 12. Each electrode is configured, for example, by appropriately patterning a transparent conductive film such as indium tin oxide (ITO). Although illustration is omitted, an insulating film may be further provided on the upper surface of each electrode. Each region where each second electrode 14 and the first electrode 13 overlap functions as a light modulation region.

The first alignment film 15 is provided on one surface side of the first substrate 11 so as to cover the first electrode 13. The second alignment film 16 is provided on one surface side of the second substrate 12 so as to cover each second electrode 14. As for each alignment film, an alignment film that regulates the alignment state of the liquid crystal layer 17 to a substantially horizontal alignment is used. Each alignment film is subjected to uniaxial alignment treatment such as rubbing treatment, and has an alignment regulating force in one direction. The direction of the alignment treatment for each alignment film is set, for example, to be substantially orthogonal to each other.

The liquid crystal layer 17 is provided between the first substrate 11 and the second substrate 12. In the present embodiment, the liquid crystal layer 17 is configured using a nematic liquid crystal material having fluidity with positive dielectric anisotropy $\Delta\varepsilon$ and containing an appropriate amount of a chiral material. The liquid crystal layer 17 of the present embodiment has an initial alignment determined by the alignment regulating force of the first alignment film 15 and the second alignment film 16, and when no voltage is applied, the alignment direction of the liquid crystal molecules is twisted at approximately 90° between the first substrate 11 and the second substrate 12. Further, the liquid crystal layer 17 has a pretilt angle of several degrees with respect to each substrate surface. When a voltage higher than a threshold voltage is applied between the first electrode 13 and the second electrode 14, the liquid crystal molecules in the liquid crystal layer 17 are untwisted and rise in the normal direction of the substrate.

Figure 5:
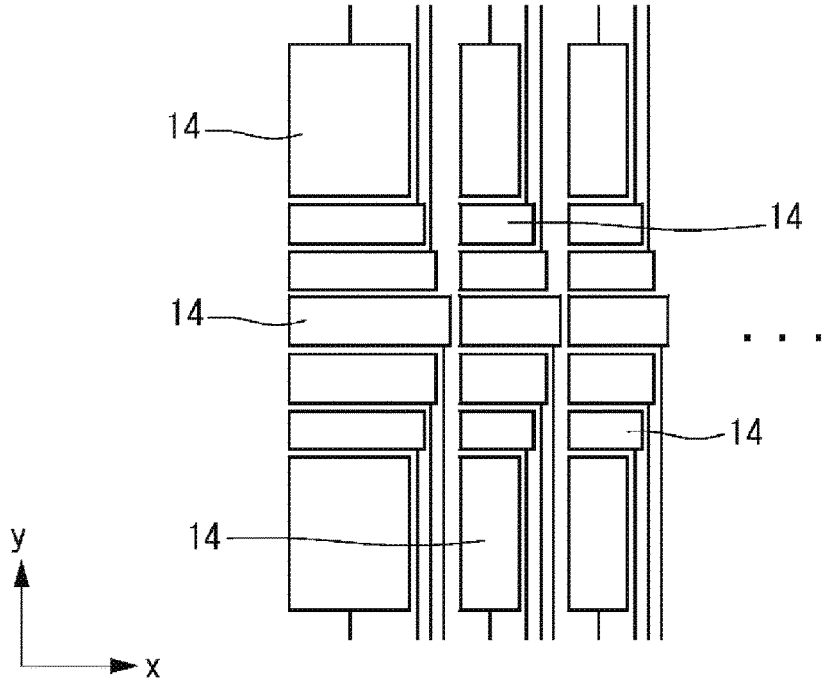
FIG. 5 is a schematic plan view showing a configuration example of each second electrode provided on the second substrate of the liquid crystal device.

FIG. 5 is a schematic plan view showing a configuration example of each second electrode provided on the second substrate of the liquid crystal device. As an example, the present embodiment assumes a liquid crystal device 4 that is statically driven, and on one surface of the second substrate 12, a plurality of second electrodes 14 each separated and independent from one another is arranged in a matrix. In FIG. 5, a portion of the plurality of second electrodes 14 is shown. Each of the second electrodes 14 in the illustrated example has a substantially rectangular shape in a plan view, but is each formed in different shapes and areas in order to correspond to various light distribution patterns. In addition, each second electrode 14 is electrically and physically separated and independent, and a wiring is associated with each second electrode so that a voltage can be applied individually.

Each wiring connected to each second electrode 14 is provided so as to extend either upward or downward in the figure. In detail, in the figure, each wiring connected to each second electrode 14 in the upper three rows extends upward, and each wiring connected to the second electrodes 14 in the lower four rows extends downward. Each wiring extends to one end side or the other end side of the second substrate 12, and is supplied with a driving voltage from an external driving device which is not shown in the figure.

In order to allow each wiring to pass through, each second electrode 14 has a different width in each row in the x direction in the figure. In detail, in the figure, with respect to the second electrodes 14 in the upper three rows, the width in the x direction becomes smaller toward the upper side along the y direction. Thereby, space for providing wiring is secured. Further, with respect to the second electrodes 14 in the lower four rows, the width in the x direction becomes smaller toward the lower side along the y direction. Thereby, space for providing wiring is secured.

Each of the second electrodes 14 is disposed so as to face the first electrode 13. By individually applying a voltage to each of the second electrodes 14 and applying a predetermined voltage to the first electrode 13, it is possible to switch between transmission and non-transmission for each light modulation region which is a region corresponding to each second electrode 14.

By adopting the liquid crystal device 4 having such a configuration and the reflective polarizing plate 3 and the polarizing plate 5 that are arranged to face each other while sandwiching the liquid crystal device 4, an image corresponding to a desired light distribution pattern can be formed, and by reversing point-symmetrically and further enlarging and projecting the image with the projection lens 7, it is possible to realize irradiation light with the desired light distribution pattern in front of the own vehicle. Specifically, as described above, it is possible to realize irradiation light in which a light irradiation region and a non-irradiation region are set according to the presence or absence of an oncoming vehicle or the like.

Hereinafter, a preferred method for manufacturing the liquid crystal device 4 included in the lamp unit will be described. A pair of glass substrates is prepared. For example, a pair of glass substrates in which a transparent conductive film such as ITO, etc. is formed in advance is used. Methods for forming the transparent conductive film include, for example, a sputtering method and a vacuum deposition method. The first electrode 13 and each of the second electrodes 14 are formed by patterning the transparent conductive film provided on the glass substrate. At this time, routing wirings is formed simultaneously (refer to FIG. 5). In this way, the first substrate 11 having the first electrode 13 and the second substrate 12 having each second electrode 14 are obtained.

Next, the first alignment film 15 is formed on the first substrate 11, and the second alignment film 16 is formed on the second substrate 12. Specifically, a horizontal alignment film material is applied to each of the first substrate 11 and the second substrate 12 by flexographic printing, an inkjet method, or the like, and then heat treatment is performed. As for the horizontal alignment film material, for example, a main chain type horizontal alignment film material is used. The film thickness of the applied material should be approximately 500 to 800 Å (angstrom). As for the heat treatment, for example, baking is to be performed at 160 to 250° C., for 1 to 1.5 hours. Here, when the liquid crystal layer 17 is to be vertically aligned, a vertical alignment film material is used instead of the horizontal alignment film material. Further, regardless of the alignment state of the liquid crystal layer 17, an alignment film material made of an inorganic material, for example, a material where a main chain skeleton consists of siloxane bonding (Si—O—Si bonding) may be used.

Next, each of the first alignment film 15 and the second alignment film 16 is subjected to an alignment treatment. As for the alignment treatment, for example, a rubbing treatment in one direction is performed. At this time, the required pressing-in amount can be set within the range from 0.3 mm to 0.8 mm, for example. Here, when the first substrate 11 and the second substrate 12 are overlaid, the directions of the rubbing treatment are set so that the directions of the rubbing treatment on each of the first alignment film 15 and the second alignment film 16 intersects at an angle of approximately 90°. The direction of the rubbing treatment is not limited thereto and can be set in various direction.

Next, a sealing material is formed on one surface of one substrate (for example, the first substrate 11). Here, a thermosetting or photocurable sealing material (epoxy, acrylic, etc.) having high heat resistance is used. Specifically, a main seal material containing an appropriate amount of gap control material (for example, 2 to 5 wt. %) is formed on one surface of the first substrate 11. The main sealing material is formed by, for example, a screen printing method or a dispenser printing method. The diameter of the gap control material included in the main seal material is selected according to the layer thickness set value of the liquid crystal layer 17, and is approximately 4 μm, for example.

Further, a gap control material is dispersed, or a rib material is formed on one surface of the other substrate (for example, the second substrate 12). In the case of using a gap control material, for example, a plastic ball having a diameter of 4 μm is sprayed by a dry-type gap material spraying device. In the case of using a rib material, a resin film is patterned.

Next, the first substrate 11 and the second substrate 12 are overlapped with each electrode formation surface facing each other, and while applying a constant pressure with a press or the like, the main sealing material is cured by heat treatment or ultraviolet irradiation. For example, when a thermosetting sealing material is used, heat treatment is performed at 150° C.

Next, a liquid crystal layer 17 is formed by filling the gap between the first substrate 11 and the second substrate 12 with a liquid crystal material. The liquid crystal material is filled by, for example, a vacuum injection method. A liquid crystal material having a positive dielectric anisotropy $\Delta\varepsilon$ and a refractive index anisotropy $\Delta n$ of, for example, approximately 0.15 can be used. Here, note that a small amount of chiral material may be added to the liquid crystal material. The filling of the liquid crystal material may also be performed by an ODF method. Here, when the liquid crystal layer 17 is vertically aligned, a liquid crystal material having a negative dielectric anisotropy is used.

After the liquid crystal layer 17 is formed, the inlet port is sealed with an end seal material. As for the end seal material, for example, an ultraviolet curable resin is used. Thus, the liquid crystal device 4 is completed.

Embodiment 2

Figure 6:
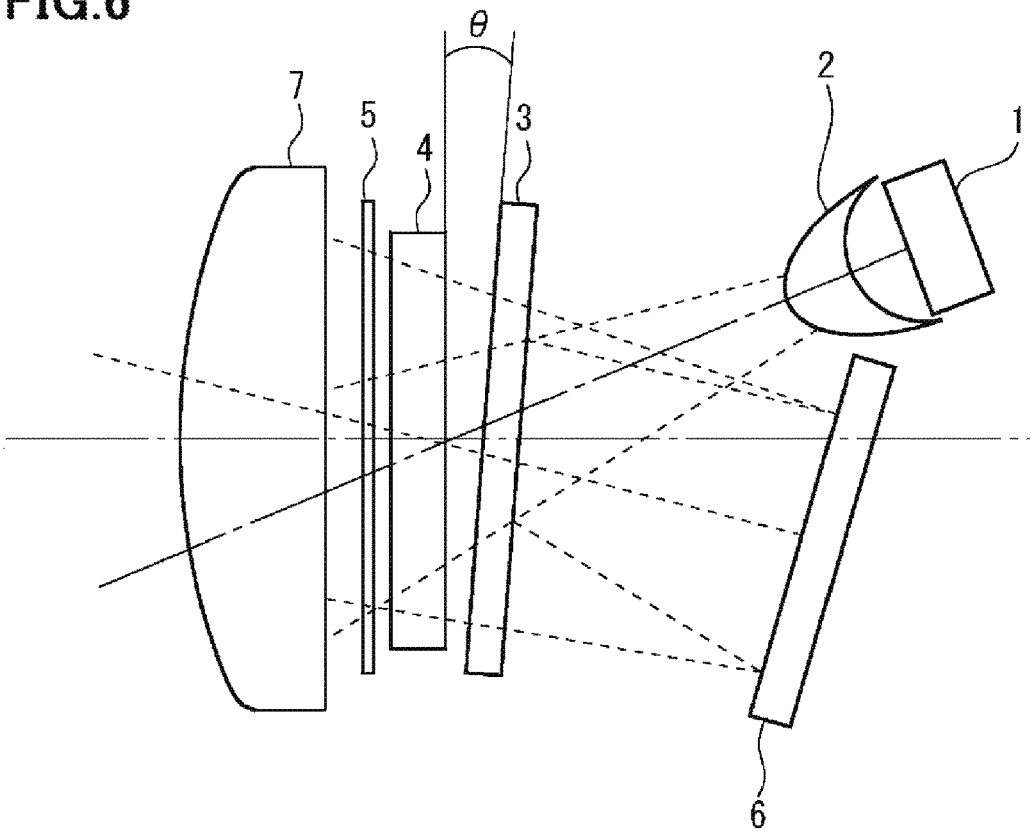
FIG. 6 is a diagram showing a configuration example of a lamp unit according to Embodiment 2.

FIG. 6 is a diagram showing a configuration example of a lamp unit in the vehicular lamp system according to Embodiment 2. The illustrated lamp unit 113R has basically the same configuration as the lamp unit 103R of Embodiment 1 described above, and is different only in that the reflective polarizing plate 3 is disposed at an angle. Specifically, in the lamp unit 113R, the liquid crystal device 4 and the polarizing plate 5 are arranged such that their respective main surfaces are substantially orthogonal to the center line (the alternate long and short dash line) of the projection lens 7. On the contrary, the reflective polarizing plate 3 is disposed obliquely with its main surface (light incident surface) having a predetermined angle $\theta$ (>0) with respect to the main surface (light incident surface) of the liquid crystal device 4.

In Embodiment 2 as well, each component is arranged so that a part of the center point of the light emitted from the light source 1 passes through the reflective polarizing plate 3 and is irradiated on the substantial center of the main surface of the liquid crystal device 4, and furthermore, a part of the light emitted from the light source 1 is regularly reflected by the reflective polarizing plate 3 to enter the reflecting mirror 6 and the central point of the reflected light when the light is reflected is irradiated to the substantial center of the main surface of the liquid crystal device 4.

Embodiment 3

Figure 7:
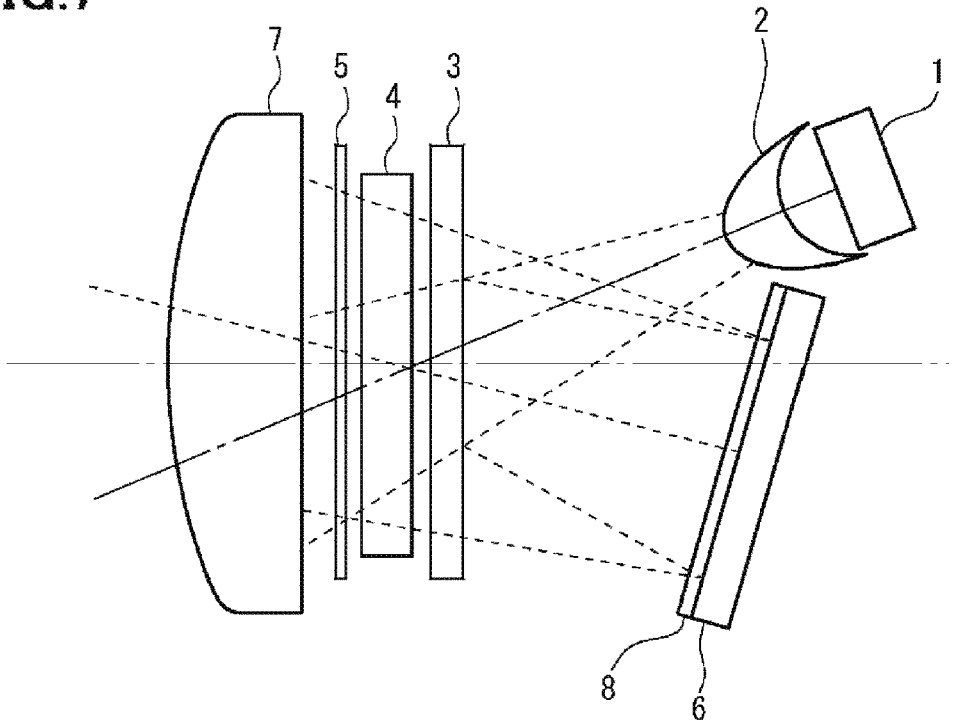
FIG. 7 is a diagram showing a configuration example of a lamp unit according to Embodiment 3.

FIG. 7 is a diagram showing a configuration example of a lamp unit in the vehicular lamp system according to Embodiment 3. The illustrated lamp unit 123R has basically the same configuration as the lamp unit 103R of Embodiment 1 described above, and is different only in that a phase difference plate 8 is additionally arranged on the front side of the reflecting mirror 6. As for the phase difference plate 8, various types such as a film-like plate, a quartz plate, a plate made of a liquid crystal polymer film, a liquid crystal panel, and the like can be used.

As for the phase difference plate 8, for example, a broadband ½ wavelength plate ($\lambda/2$ plate), ¼ wavelength plate ($\lambda/4$ plate), ¾ wavelength plate ($3\lambda/4$ plate) or the like can be used. When a ¼ wavelength plate is used as the phase difference plate 8, it is preferable that the slow axis direction is arranged at an angle of approximately 45° with respect to the polarization axis of the reflective polarizing plate 3, and when a ½ wavelength plate is used, it is preferable that the slow axis direction is arranged at an angle of approximately 22.5° with respect to the polarization axis of the reflective polarizing plate 3. With such an arrangement, for example, a linearly polarized light in a predetermined direction of reflected light created by the reflective polarizing plate 3 passes through the ¼ wavelength plate once to become a circularly polarized light, then the light is reflected by the reflecting mirror 6 to pass through the ¼ wavelength plate again to become a linearly polarized light whose polarization direction is rotated by 90° from the predetermined direction, and re-enters the reflective polarizing plate 3, so that most of the light component passes through the reflective polarizing plate 3.

When generalized, the frequency in which light emitted from the light source 1 passes through the phase difference plate 8 becomes 2n (n: a natural number). And the phase difference given by the phase difference plate 8 is, for example, $\lambda/2n-\lambda/4$ (n: a natural number), where $\lambda$ is the wavelength of the light. The polarization direction of the light which is reflected by the reflective polarizing plate 3, then reflected by the reflective mirror 6 and re-enters the reflective polarizing plate 3 is changed by (180n−90)° (n: an integral number) by the phase difference plate 8.

Here, in the lamp unit 123R shown in FIG. 7 as well, the reflective polarizing plate 3 may be inclined in the same manner as the lamp unit 113R of Embodiment 2 described above.

Embodiment 4

Figure 8:
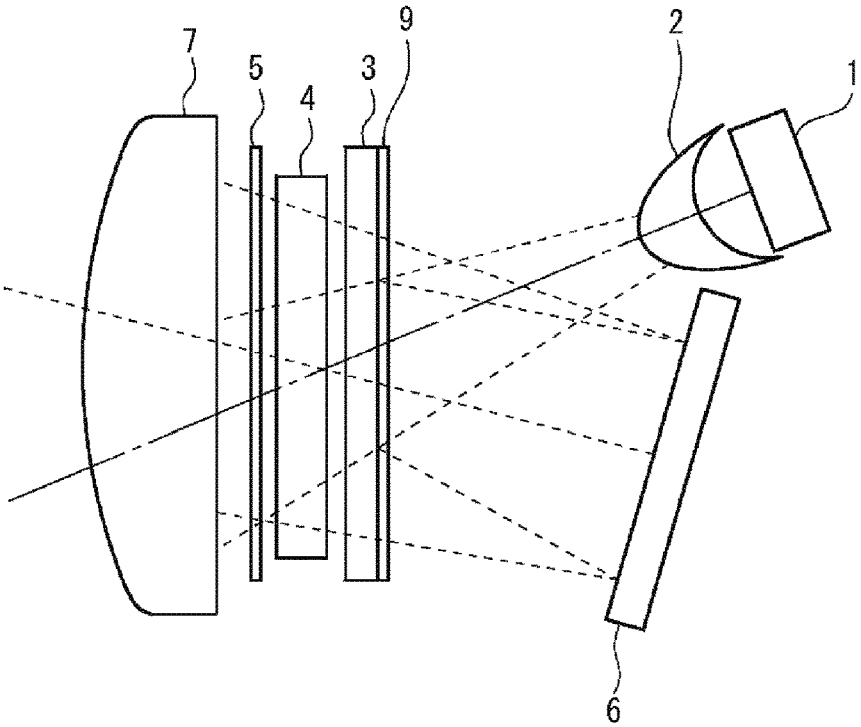
FIG. 8 is a diagram showing a configuration example of a lamp unit according to Embodiment 4.

FIG. 8 is a diagram showing a configuration example of a lamp unit in the vehicular lamp system according to Embodiment 4. The illustrated lamp unit 133R is configured to include a light source 1, a collimating lens 2, a reflective polarizing plate (a reflecting polarizer) 3, a liquid crystal device 4, a polarizing plate 5, a reflecting mirror 6, a projection lens 7, and a phase difference plate 9. Since the configuration other than the phase difference plate 9 is the same as that of the lamp unit 103R (103L) of Embodiment 1 described above, the description thereof is omitted.

The phase difference plate 9 is disposed on the light incident surface side of the reflective polarizing plate 3, and gives a phase difference to incident light. As for the position where the phase difference plate 9 is disposed, for example, it is preferably disposed in close contact with the light incident surface side of the reflective polarizing plate 3 as illustrated in the figure, but in principle, it may be disposed anywhere on the optical path between the light source 1 and the reflective polarizing plate 3. As for the phase difference plate 9, for example, a broadband ½ wavelength plate ($\lambda/2$ plate), ¼ wavelength plate ($\lambda/4$ plate), ¾ wavelength plate ($3\lambda/4$ plate), or the like can be used. In this case, polycarbonate (PC), cycloolefin (COP) or the like can be used as the material.

When a ¼ wavelength plate is used as the phase difference plate 9, it is preferable that the slow axis direction is arranged at an angle of approximately 45° with respect to the polarization axis of the reflective polarizing plate 3, and when a ½ wavelength plate is used, it is preferable that the slow axis direction is arranged at an angle of approximately 22.5° with respect to the polarization axis of the reflective polarizing plate 3. With such an arrangement, for example, a linearly polarized light in a predetermined direction of reflected light created by the reflective polarizing plate 3 passes through the ¼ wavelength plate once to become a circularly polarized light, then the light is reflected by the reflecting mirror 6 to pass through the ¼ wavelength plate again to become a linearly polarized light whose polarization direction is rotated by 90° from the predetermined direction, and re-enters the reflective polarizing plate 3, so that most of the light components pass through the reflective polarizing plate 3.

When generalized, the frequency in which light emitted from the light source 1 passes through the phase difference plate 9 becomes (2n−1) (n: a natural number). And the phase difference given by the phase difference plate 9 is, for example, $\lambda/2n-\lambda/4$ (n: a natural number), where $\lambda$ is the wavelength of the light. The polarization direction of the light which is reflected by the reflective polarizing plate 3, then reflected by the reflective mirror 6 and re-enters the reflective polarizing plate 3 is changed by (180n−90)° (n: an integral number) by the phase difference plate 9.

In this lamp unit 133R, each component is arranged so that all components of light emitted from the light source 1 (including light reflected by the reflecting mirror 6) are incident on each light control function part (light control electrode forming part which is to be described later) of the liquid crystal device 4 as well as the opening portion of the reflective polarizing plate 3 and the opening portion of the projection lens 7.

Embodiment 5

Figure 9:
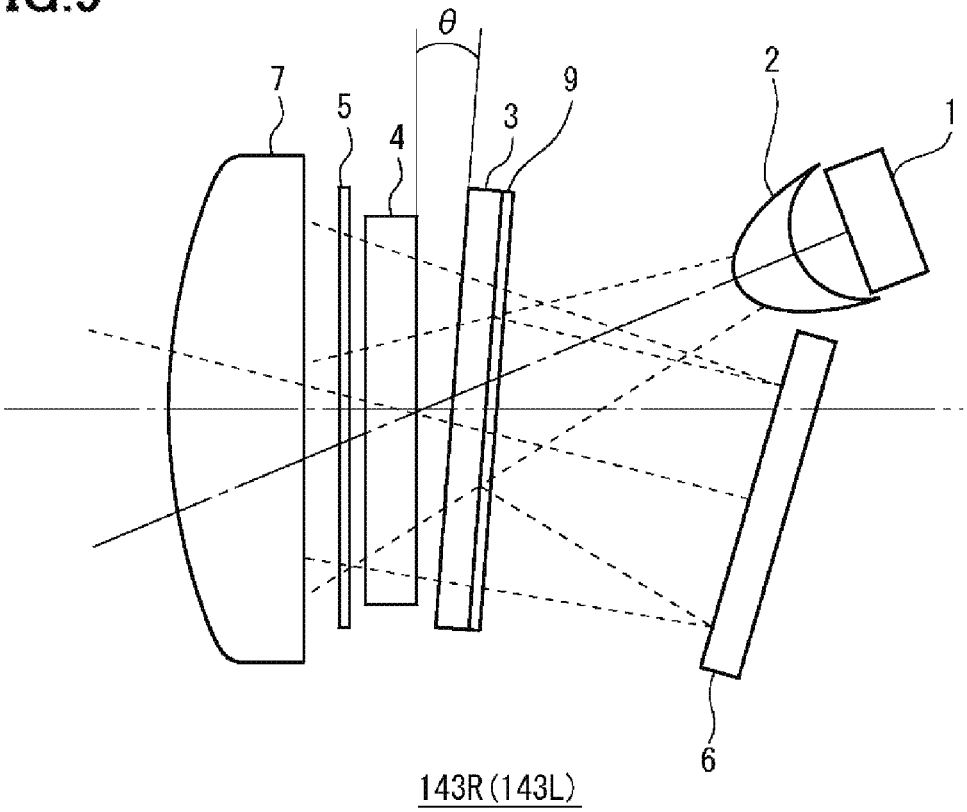
FIG. 9 is a diagram showing a configuration example of a lamp unit according to Embodiment 5.

FIG. 9 is a diagram showing a configuration example of a lamp unit in the vehicular lamp system according to Embodiment 5. The illustrated lamp unit 143R has basically the same configuration as the lamp unit 133R of Embodiment 4 described above, and is different only in that a reflective polarizing plate 3 and a phase difference plate 9 are disposed at an angle. Specifically, in the lamp unit 143R, the liquid crystal device 4 and the polarizing plate 5 are arranged so that their respective main surfaces are substantially orthogonal to the center line (the alternate long and short dash line) of the projection lens 7. On the contrary, the reflective polarizing plate 3 and the phase difference plate 9 are each inclined with a predetermined angle $\theta$ (>0) between their main surfaces (light incident surfaces) and the main surface (the light incident surface) of the liquid crystal device 4.

In Embodiment 5 as well, each component is arranged so that a part of the center point of the light emitted from the light source 1 passes through the reflective polarizing plate 3 and the phase difference plate 9, and is irradiated on the substantial center of the main surface of the liquid crystal device 4, and furthermore, a part of the light emitted from the light source 1 is regularly reflected by the reflective polarizing plate 3 to enter the reflecting mirror 6, and the central point of the reflected light when the light is reflected is irradiated to the substantial center of the main surface of the liquid crystal device 4.

Embodiment 6

Figure 10:
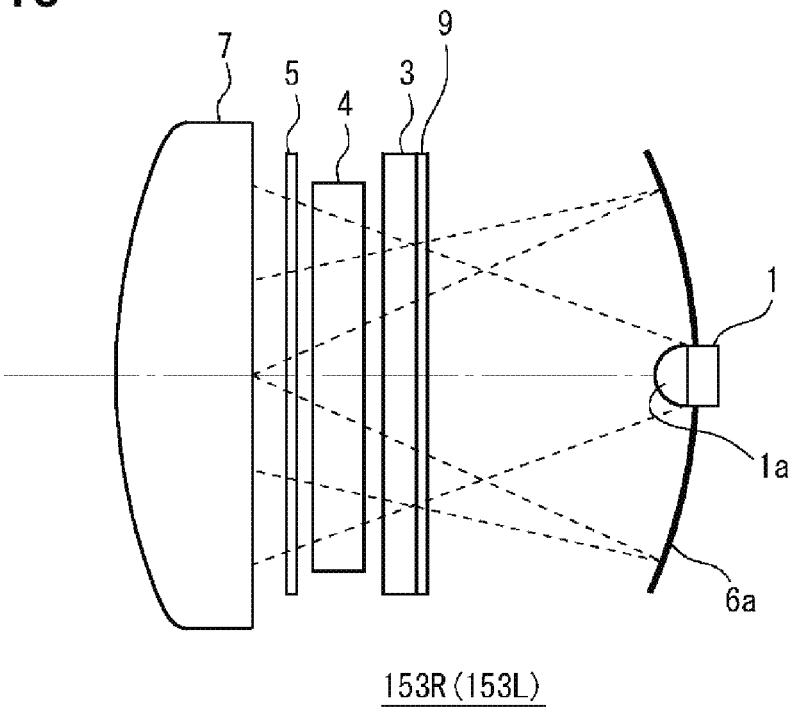
FIG. 10 is a diagram showing a configuration example of a lamp unit according to Embodiment 6.

FIG. 10 is a diagram showing a configuration example of a lamp unit in the vehicular lamp system according to Embodiment 6. The illustrated lamp unit 153R has basically the same configuration as the lamp unit 133R of Embodiment 4 described above, and only the configurations of the light source 1 and the reflecting mirror **6*a* are different. In detail, in the lamp unit 153R of Embodiment 6, the light source 1 is arranged so that its optical axis coincides with the central axis (the optical axis) of the optical system including the projection lens 7, etc. Further, the reflecting mirror 6*a*** has, for example, a curved reflecting surface such as a concave mirror, and is disposed so as to surround at least the light emitting part 1*a* of the light source 1. Although such a lamp unit 153R creates some loss in terms of light utilization efficiency due to the strong light component at the center of the light source 1 being regularly reflected by the reflective polarizing plate 3 to return to the light source 1 again, there is an advantage that the configuration is simple and the optical system can easily be made compact. The lights from the light source 1 including the direct light and the reflected light from the reflecting mirror 6*a* are incident on the main surfaces of the liquid crystal element 4 and the projection lens 7. In this case, the direct light passes through the phase difference plate 9 once, and the reflected light passes through the phase difference plate (1+2n) times (n: a natural number).

Here, in the lamp unit 153R shown in FIG. 10 as well, the reflective polarizing plate 3 and the phase difference plate 9 may be tilted in the same manner as the lamp unit 143R of Embodiment 5 described above.

Embodiment 7

Figure 11:
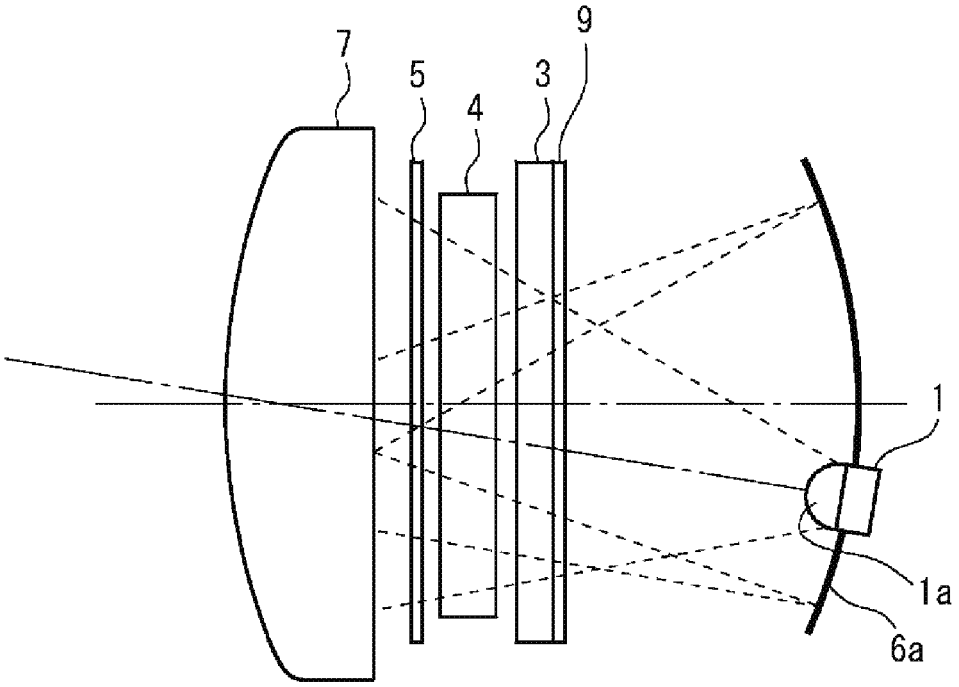
FIG. 11 is a diagram showing a configuration example of a lamp unit according to Embodiment 7.

FIG. 11 is a diagram showing a configuration example of a lamp unit in the vehicular lamp system according to Embodiment 7. The illustrated lamp unit 163R has basically the same configuration as the lamp unit 153R of Embodiment 6 described above, and the only difference is the position where the light source 1 is arranged. In detail, in the lamp unit 163R of Embodiment 7, the light source 1 is arranged at a slightly shifted position so as not to coincide with the central axis (the optical axis) of the optical system including projection lens 7, etc. The optical axis of the light source 1 obliquely intersects the central axis of the optical system. In this case, since the strong light component at the center of the light source 1 does not return to the light source 1 even when it is regularly reflected by the reflective polarizing plate 3, there is an advantage that the light use efficiency can easily be increased.

According to each embodiment as described above, since the reflected light from the reflective polarizing plate of the lamp unit is reflected by the reflecting mirror and re-enters the reflective polarizing plate, the light utilization efficiency can be improved. Therefore, it is possible to increase the light utilization efficiency in the vehicular lamp system that performs selective light irradiation using liquid crystal elements. Further, when the polarization direction is adjusted by using a phase difference plate, the light utilization efficiency can further be increased.

It should be noted that this invention is not limited to the subject matter of the foregoing embodiments, and can be implemented by being variously modified within the scope of the present invention as defined by the appended claims. For example, in the above-described embodiments, a normally black mode is assumed as the operation mode of the liquid crystal device, but the operation mode may also be a normally white mode. Further, the liquid crystal device is exemplified by a liquid crystal layer having a twisted alignment (TN alignment), but is not limited thereto. A liquid crystal device of any operation mode is acceptable as long as it is capable of controlling the transmissive or non-transmissive state of partial region of light. Further, an optical compensator such as a C plate may be appropriately combined with the liquid crystal device.

Further, the above embodiments describe the cases where the present invention is applied to a vehicular lamp system that performs selective light irradiation according to the presence or absence of an oncoming vehicle or the like in front of the vehicle, but the application of this invention is not limited thereto. For example, the present invention can be applied to a vehicular lamp system that switches light irradiation according to the turning direction of the vehicle, or a vehicular lamp system that variably controls the optical axis direction of the headlamp according to the inclination angle of the vehicle in the front-rear direction. Further, the present invention can be applied to a vehicular lamp system that switches between a high beam and a low beam in a headlamp without depending on a mechanical operation part.

Further, the lamp unit according to the present invention can be used not only for use in vehicles but also for various uses as a lighting device capable of generating various light distribution patterns.

1: light source
2: collimating lens
3: reflecting polarizer
4: liquid crystal device
5: polarizing plate
6: reflecting mirror
7: projection lens
8: phase difference plate
101: camera
102: control part
103R, 103L: lamp units

What is claimed is:

1. A lamp unit comprising:
a light source;
a reflective polarizing plate disposed at a position where light from the light source is incident;
a reflecting mirror configured to reflect a reflected light generated by the reflective polarizing plate and re-enters the reflected light to the reflective polarizing plate;
a liquid crystal device disposed on the light emitting surface side of the reflective polarizing plate;
a polarizing plate disposed on the light emitting surface side of the liquid crystal device; and
a lens disposed on the light emitting surface side of the polarizing plate; wherein
the light source is arranged so that its optical axis intersects the normal direction of the light incident surface of the reflective polarizing plate.

2. A lamp unit comprising:
a light source;
a reflective polarizing plate disposed at a position where light from the light source is incident;
a reflecting mirror configured to reflect a reflected light generated by the reflective polarizing plate and re-enters the reflected light to the reflective polarizing plate;
a liquid crystal device disposed on the light emitting surface side of the reflective polarizing plate;
a polarizing plate disposed on the light emitting surface side of the liquid crystal device; and
a lens disposed on the light emitting surface side of the polarizing plate,
wherein the reflective polarizing plate is disposed obliquely with its main surface having an angle larger than 0° with respect to the main surface of the liquid crystal device.

3. A lamp unit comprising:
a light source;
a reflective polarizing plate disposed at a position where light from the light source is incident;

a reflecting mirror configured to reflect a reflected light generated by the reflective polarizing plate and re-enters the reflected light to the reflective polarizing plate;

a liquid crystal device disposed on the light emitting surface side of the reflective polarizing plate;

a polarizing plate disposed on the light emitting surface side of the liquid crystal device;

a lens disposed on the light emitting surface side of the polarizing plate;

a phase difference plate arranged between the reflective polarizing plate and the reflective mirror.

4. The lamp unit according to claim 3:

wherein the phase difference plate is arranged on the front side of the reflecting mirror.

5. The lamp unit according to claim 3:

wherein the phase difference plate is arranged on the light incident surface side of the reflective polarizing plate.

6. The lamp unit according to claim 1:

wherein the reflecting mirror has a curved reflecting surface and is disposed so as to surround the light emitting part of the light source.

7. A vehicular lamp system comprising:

the lamp unit according to claim 1, and a controller configured to control operations of the light source and the liquid crystal device of the lamp unit.

8. A vehicular lamp system comprising:

the lamp unit according to claim 2, and a controller configured to control operations of the light source and the liquid crystal device of the lamp unit.

9. A vehicular lamp system comprising:

the lamp unit according to claim 3, and a controller configured to control operations of the light source and the liquid crystal device of the lamp unit.

* * * * *